US005896992A

United States Patent [19]

McGrath

[11] Patent Number: 5,896,992

[45] Date of Patent: Apr. 27, 1999

[54] NESTABLE BAKERY TRAY

[75] Inventor: Patrick James McGrath, Plano, Fla.

[73] Assignee: Alpha Holdings, Inc., Dallas, Tex.

[21] Appl. No.: 09/094,127

[22] Filed: Jun. 9, 1998

[51] Int. Cl.[6] ..... B65D 21/032

[52] U.S. Cl. ..... 206/507; 206/505; 206/506; 206/518

[58] Field of Search ..... 206/505, 507, 206/509, 511, 515, 518, 506; 220/23.6, 4.26, 4.27

[56] References Cited

U.S. PATENT DOCUMENTS

| | | | |
|---|---|---|---|
| 4,000,817 | 1/1977 | Sanders et al. | 206/505 |
| 4,189,052 | 2/1980 | Carroll et al. | 206/507 |
| 4,334,616 | 6/1982 | Wilson . | |
| 4,383,611 | 5/1983 | Kreeger . | |
| 4,426,001 | 1/1984 | Stahl et al. | 206/505 |
| 4,619,366 | 10/1986 | Kreeger | 206/507 |
| 4,759,451 | 7/1988 | Apps . | |
| 4,936,458 | 6/1990 | Tabler et al. | 206/507 |
| 4,960,207 | 10/1990 | Tabler et al. . | |
| 4,971,202 | 11/1990 | Box | 206/507 |
| 5,035,326 | 7/1991 | Stahl . | |
| 5,582,296 | 12/1996 | Beachamp et al. . | |
| 5,752,602 | 5/1998 | Ackermann et al. | 206/507 |

FOREIGN PATENT DOCUMENTS

| | | | |
|---|---|---|---|
| 1086256 | 10/1967 | United Kingdom | 206/507 |

*Primary Examiner*—Stephen Castellano

*Attorney, Agent, or Firm*—Robert L. Wolter, Esq.; Holland & Knight LLP

[57] ABSTRACT

A bakery tray having a substantially rectangular floor has a retainer wall extending along a periphery of the floor. The retainer wall includes a front wall opposing a rear wall, and a first side wall opposing a second side wall. Two feet are spaced apart horizontally on the first side wall, and two feet are horizontally spaced apart on the second side wall. A first pair of nesting pockets are disposed along the exterior surface of the first side wall above the feet on the same wall; and a second pair of nesting pockets are disposed along an interior surface of the second side wall above the feet on the same wall. When bakery trays of a like configuration are stacked, the feet on the first side wall of a top tray seat within the nesting pockets on the second side wall, and the feet on the second side wall seat within the first nesting pockets on the first side wall of a bottom tray. When trays are stacked, the feet on the first side wall of a top tray stack atop the first side wall of a bottom tray, and the feet on the second side wall of a top tray stack atop the second side wall of a bottom tray to support the top tray on a bottom tray.

33 Claims, 12 Drawing Sheets

NESTABLE BAKERY TRAY

FIELD OF THE INVENTION

This invention relates to those crates or trays used for storing and transporting baked goods and the like. More specifically, this invention pertains to such trays that are stackable and/or nestable at multiple heights with trays of a similar configuration.

BACKGROUND

Baked goods are stored and transported in plastic trays, which also display the goods on store shelves. Bakery products by their nature are soft products so the trays must be stackable to provide a protected interior space intermediate stacked trays and avoid crushing the bakery products. Many trays are stackable at multiple levels to accommodate baked goods of different heights or shapes. U.S. Pat. Nos. 4,383,611, 4,759,451, and 5,035,326 each disclose baskets or trays for bakery products that are stackable on like trays at three different levels. In addition, the bakery trays are designed to be stacked with like empty trays to nest at a minimum stacking height in order to save space for transportation and storage.

Generally, these multi-level stacking trays have a floor disposed within an outer rectangular wall including two end walls and two side walls. A plurality of support means in the form of legs, feet or lugs are spaced apart along an exterior surface of the side walls to support the tray on other trays in various stacked and/or nested levels. Recesses are spaced apart along an interior surface of the side walls. The support legs and the recesses are positioned on the side walls so the support legs engage the recesses and support the tray in a stacked position. These recesses and the like have ledges or platforms positioned at multiple levels. The support legs may be stationed over the ledges or platforms on the different levels. Unfortunately, these tray designs are awkward to handle when stacking the trays. The trays may require a precise alignment of the support feet or legs within the corresponding recesses and on the respective stacking ledge or platform.

Other tray designs may provide an easier stacking configuration to avoid the above referenced problem to multi-level stacking trays. For instance, U.S. Pat. No. 4,960,207, issued to Tabler, discloses a bakery tray that permits blind stacking of the trays. The Tabler bakery tray utilizes different proportioned feet disposed along side walls that correspond to recesses along an interior surface of the side walls. The trays nest when aligned in a first position whereby the feet of a top tray correspond to recesses in a bottom tray. When the upper tray is oriented 180 degrees with respect to the bottom tray, the support feet are vertically misaligned with the recesses, and the trays stack at a high position. In addition, the upper tray is slidable on the bottom tray by means of the support feet engaging a channel extending along the side wall. However, this tray requires some precision by mating the feet with the channel.

SUMMARY OF THE INVENTION

In view of the foregoing, it is an object of the present invention to provide a bakery tray that is stackable and/or nestable at different heights. Another object of this invention is to provide bakery trays of a like design so a top tray is self-aligning on a bottom tray, and slidable thereon for stacking or nesting the trays.

These and other objectives are achieved by providing a bakery tray that is stackable and/or nestable with trays of a similar configuration at different heights. A top tray nests within a bottom tray when placed thereon in a first position, with respect to the bottom tray; and stacks atop the bottom tray when placed thereon in a second position with respect to the bottom tray. The bakery tray includes a retainer wall integrally attached to a floor. The retainer wall comprises a front wall, a rear wall, a first side wall and a second side wall. An upper wall portion of the retainer wall is displaced outward with respect to the lower wall portion, toward an exterior of the tray. This wall displacement allows the lower wall portion and floor of a top tray to nest within the upper wall portion of a bottom tray.

Feet, projecting outwardly from the side walls, are spaced apart along the exterior surfaces of the first side wall and second side wall, and brace the tray in a stacked or nested position on similarly configured trays. Each of the feet has a substantially horizontally disposed support member that engages corresponding ledges or rails on a bottom tray to support a top tray on a bottom tray. Each of the first and second side walls has a horizontally extending top planar surface. In addition, a top rail extends longitudinally along each of the first and second side walls and is coplanar with the top surface of the side walls. The top rail has a dimension extending laterally outward from the side walls. The support members along the first side wall are positioned directly below the top planer surface of the first side wall. The support members along the second side wall, having been spaced from the side wall, are positioned directly below the top rail on the second side wall.

Nesting pockets are positioned along the first side walls and second side walls for receiving the feet in an instance when a top tray is nested within a bottom tray. The nesting pockets are generally configured for mating relationship with the feet, but each includes a horizontally disposed nesting ledge to brace the support member on a respective foot. Two nesting pockets are disposed along the exterior of the first side wall for receiving the feet and support members on the second side wall, and two nesting pockets are spaced apart along the interior of the second side wall for receiving the feet and support members on the first side wall.

When a top tray is placed on a bottom tray in a nesting position, the first side wall on the top tray extends over the second side wall on the bottom tray, and the second side wall on the top tray extends over the first side wall of the bottom tray. Each of the feet on the first side wall of the top tray seats within corresponding nesting pockets on the second side wall of the bottom tray, and each of the feet along the upper wall's second side wall seat within nesting pockets disposed along the exterior of the first side wall.

When the top tray is placed on the bottom tray in a stacked position, the first side wall and second side walls on a bottom tray are aligned over the same respective side walls on the bottom tray. The feet along the first side wall rest on the top surface of the bottom tray's first side wall, and the feet on the top tray's second side wall rest on the top rail of the bottom tray's second side wall. The floor of the top tray depends from the retainer wall and is disposed within the upper wall portion of the bottom tray when the trays are stacked, locking the top tray in place atop the bottom tray.

DETAILED DESCRIPTION OF THE DRAWINGS

Figure 1:
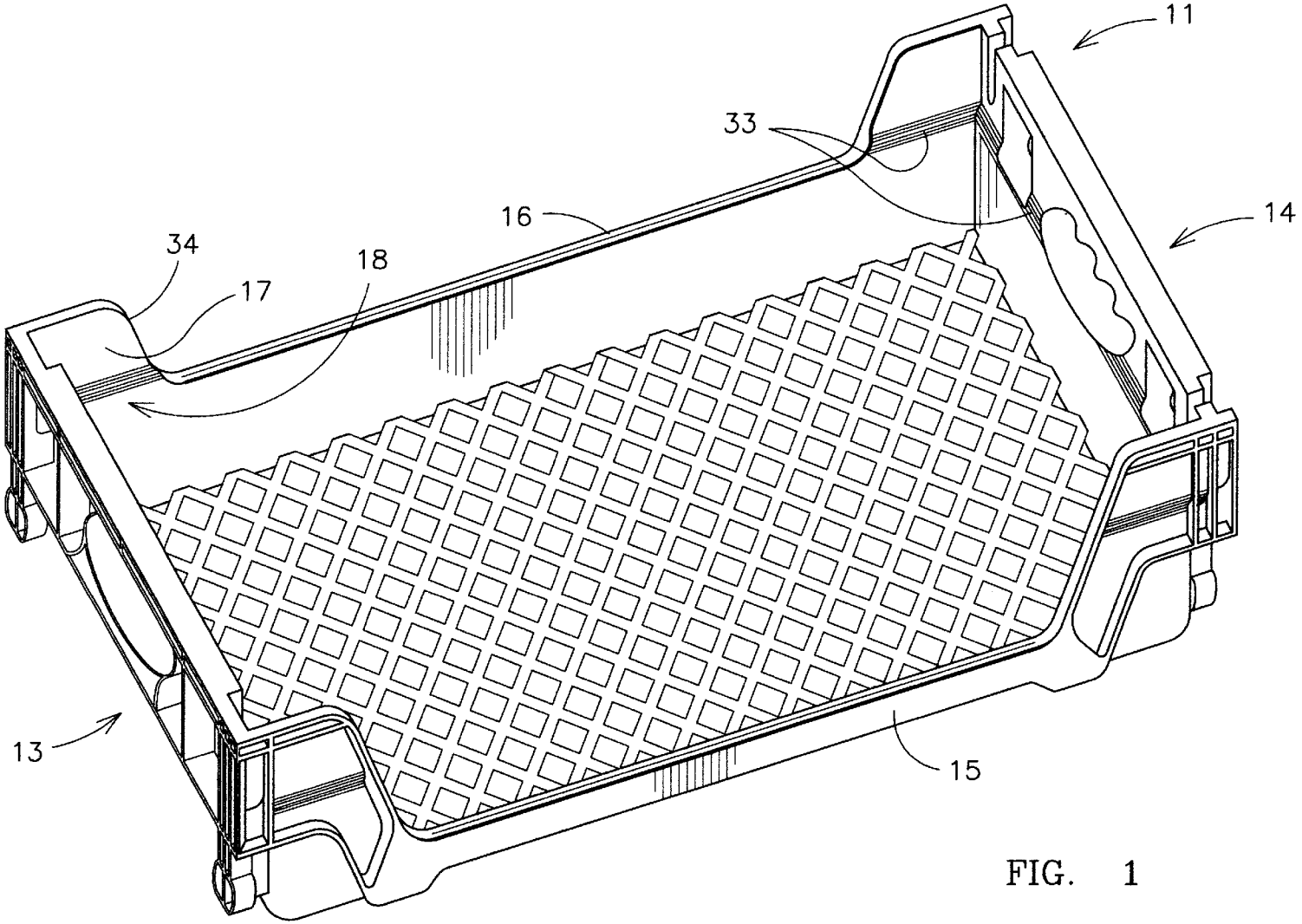
FIG. 1 is a top perspective view of the invention.
Figure 2:
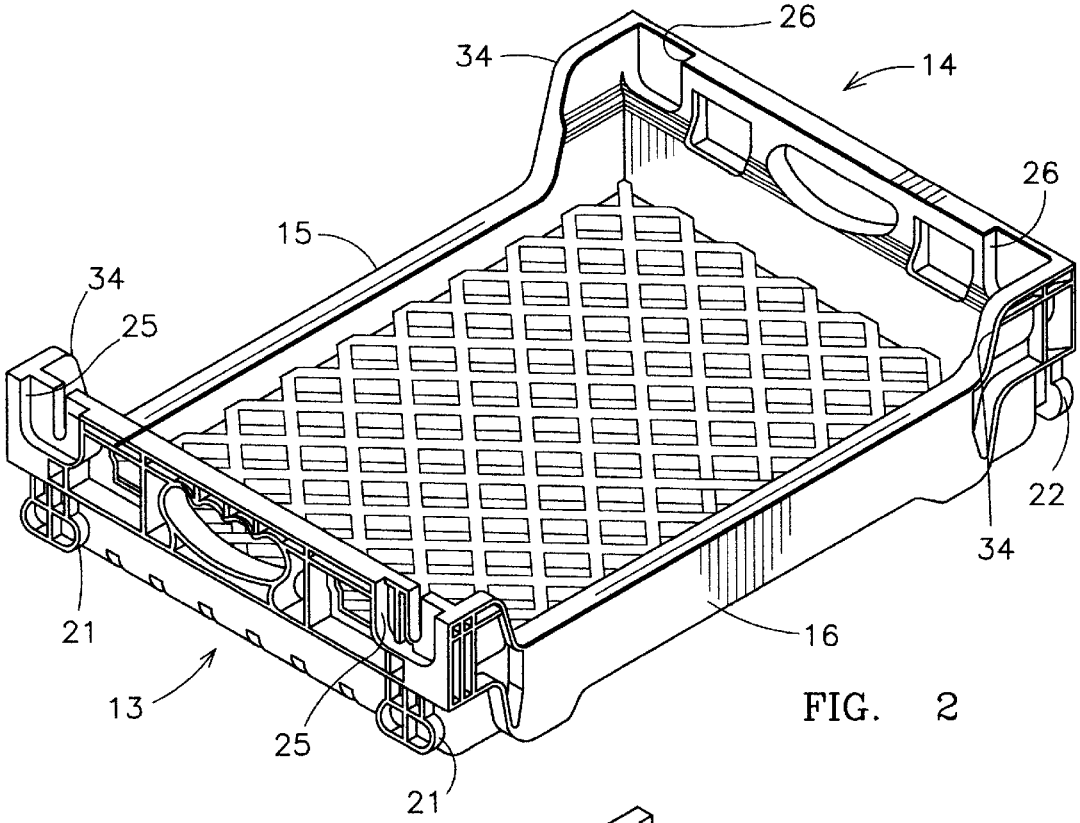
FIG. 2 is a rear perspective view of the invention.
Figure 3:
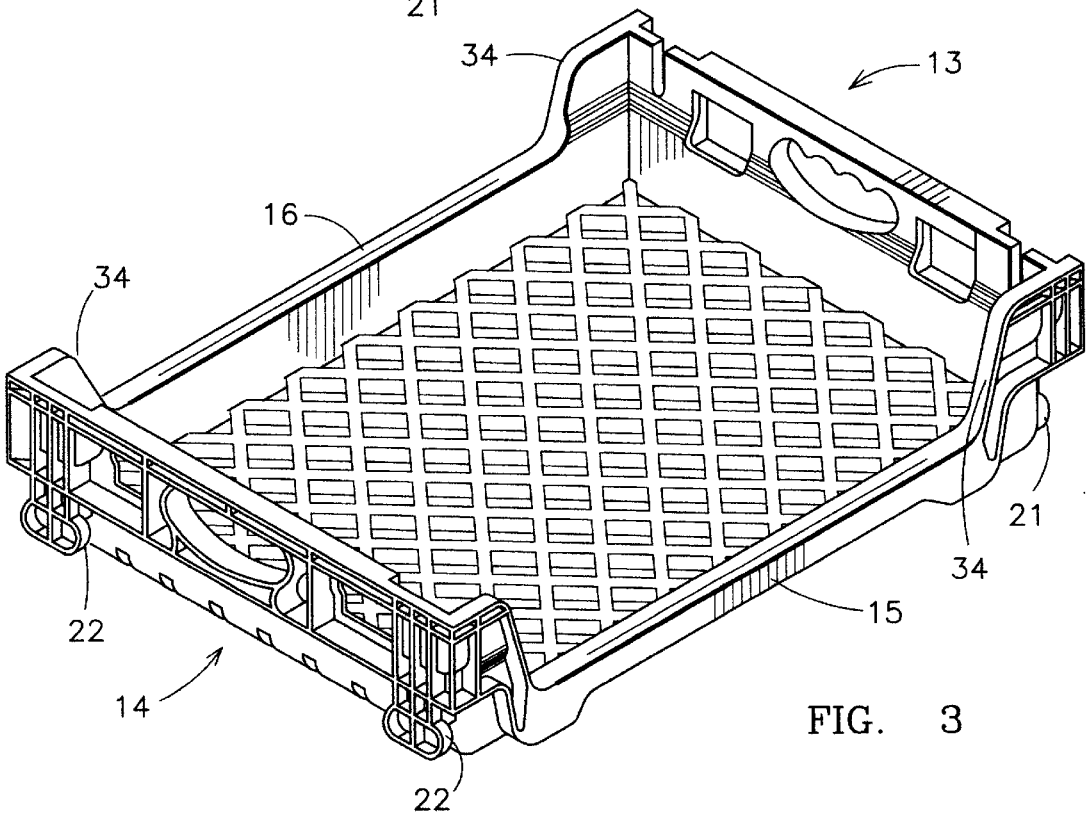
FIG. 3 is a front perspective view of the invention.

The nestable bakery tray 11 is illustrated in FIGS. 1, 2 and 3. The bakery tray 11 includes a rectangular floor 12 with a first side wall 13, a second side wall 14, a front wall 15 and a rear wall 16. The walls 13 through 16 are integrally attached to one another and to the floor 12 which depends from the walls 13 through 16. The rear wall 16 extends between the side walls 13 and 14, at a height lower than that of the side walls 13 and 14. The rear wall 16 also includes an extension or height increasing means 34 adjacent each side wall 13 and 14. The extensions 34 are the same height as that of the side walls 13 and 14. The front wall 15 has a similar construction as the rear wall 16; however the front wall 15 is lower than the rear wall 16 between the extensions 34 for product display purposes.

Each of the side walls 13 and 14, the front wall 15 and rear wall 16 includes an upper wall portion 17 and a lower wall portion 18. The upper wall portion 17 of each of the side walls 13 and 14, the front wall 15 and rear wall 16 is displaced outward with respect to the lower wall portion 18, toward an exterior of the bakery tray 11. The displacement forms a shoulder 33 extending along the side walls 13 and 14, and the extensions 34, intermediate the upper wall portion 17 and lower wall portion 18. As will be explained in more detail below, this wall displacement facilitates nesting of the floor 12 and lower wall portion 18 of a top tray within the upper wall portion 17 of a lower empty tray. In addition, when trays are stacked the floor 12 of a upper tray is disposed within upper wall portion 17 of a bottom tray.

With respect to FIGS. 1–3 and 9–12, a bottom rail 20 extends horizontally along the exterior of the tray 11 on each side wall 13 and 14. The bottom rails 20 are disposed on the exterior of the side walls 13 and 14 above floor 12 and below the shoulder 33. In addition, a top rail 24 is vertically spaced above, and parallel with, the bottom rail 20. A plurality of ribs extend vertically between the bottom rail 20 and the top rail 24 to maintain the overall structural integrity of the side walls 13 and 14, and the tray 11. The top rail 24 is coplanar with a top surface 38 of each of the side walls 13 and 14, and extends longitudinally along a side wall 13 or 14 integral to the top surface 38. The top rail 24 has a lateral dimension that extends outward from the side wall 13 or 14. As will be explained in more detail below, the top rail 24 and top surface 38 provide horizontally disposed planar surfaces for supporting like trays stacked or nested on the tray 11.

Feet 21 and 22 are positioned along the exterior surface of the side walls 13 and 14 respectively and support the tray 11 in a stacked or nesting position. The feet 21 and 22 each include a horizontally disposed support member 36 defining a bottom of the foot 21 or 22. Arcuate members 41 are integrally attached to each end of the support member 36 forming an oval shape of the feet 21 and 22. The horizontally disposed support member 36 that braces the tray 11 when stacked or nested with other trays. Vertical ribs 42 attach the feet 21 and 22 to the bottom rail 20 and the side walls 13 and 14. In a stacked position, the feet 21 on the first side wall 13 engage the top surface 38 of a bottom tray and feet 22 on the second side wall 14 engage the top rail 24 of a bottom tray. The horizontally disposed support member 36 that braces the tray 11 when stacked or nested with other trays. In a nested position the feet 21 and 22 seat within nesting pockets 25 and 26 disposed along the side walls 13 and 14 respectively.

Figure 9:
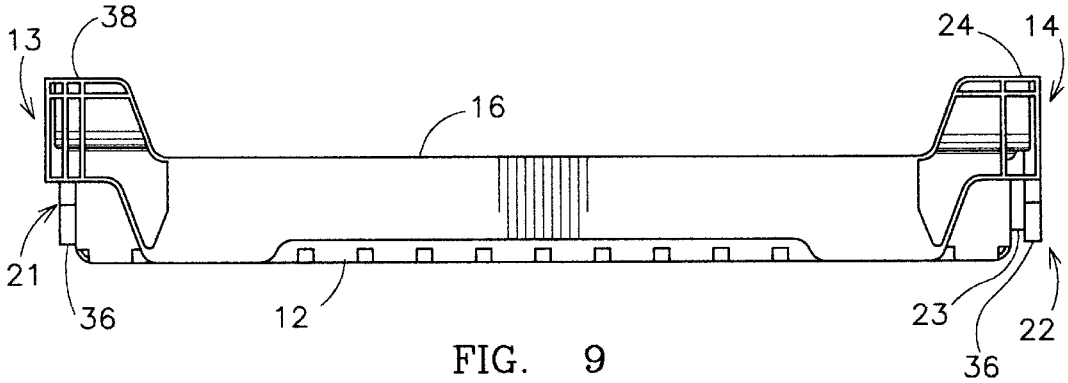
FIG. 9 is a rear elevational view of the invention.
Figure 10:
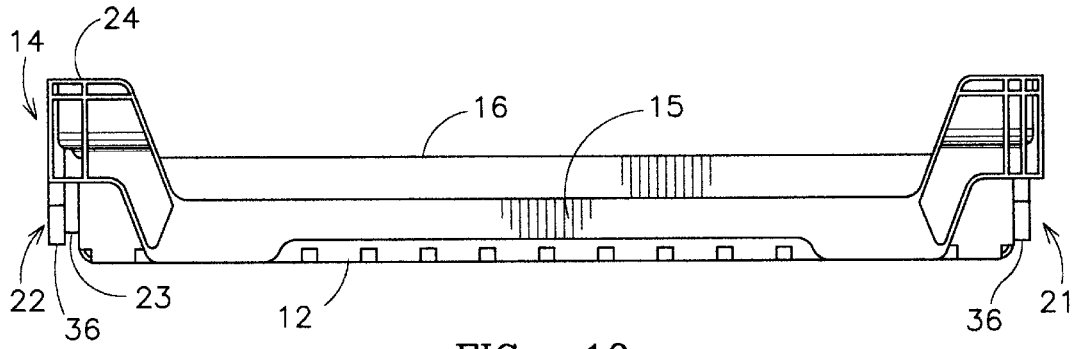
FIG. 10 is a front elevational view of the invention.
Figure 11:
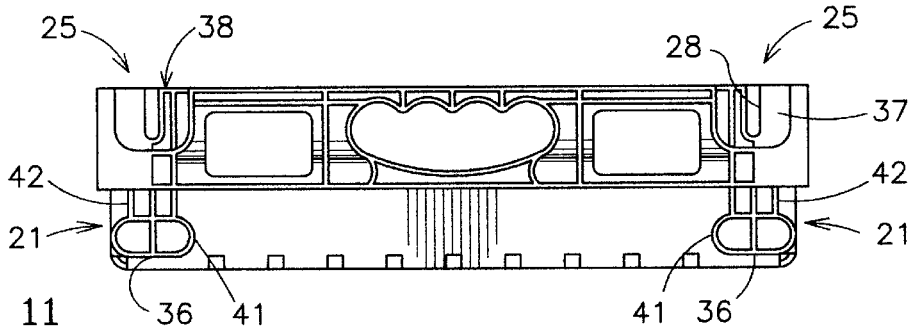
FIG. 11 is a first elevational side view of the invention.
Figure 12:
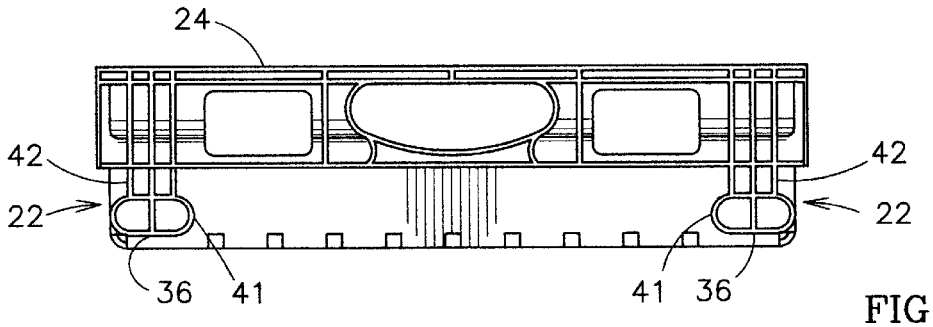
FIG. 12 is a second elevational side view of the invention.
Figure 13:
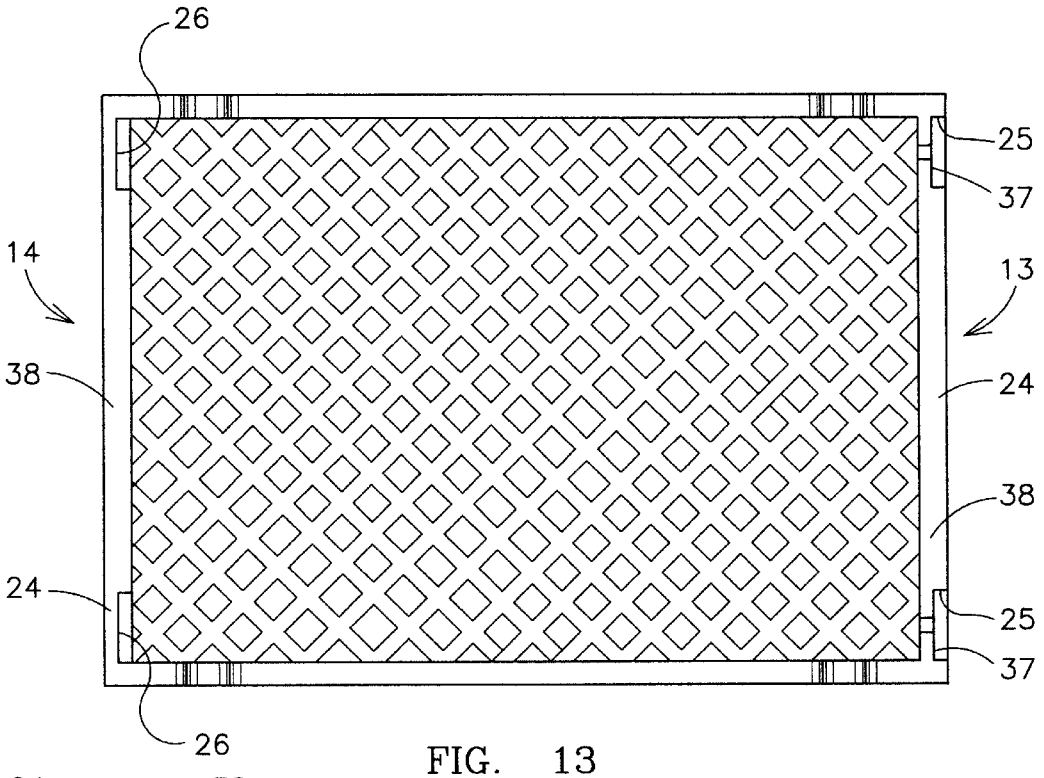
FIG. 13 is a top view of the invention.

With respect to the feet 21 on the first side wall 13, the support members 36 are horizontally spaced apart along the lower wall portion 18 of the first side wall 13. The upper wall portion 17 is displaced toward an exterior of the tray 11. As shown in FIGS. 9 and 10, the support members 36 extend parallel to, and at least a portion of the support members are aligned directly underneath, the top surface 38 of the side wall 13. The support members 36 on feet 22 are horizontally spaced apart along the lower portion of the second side wall 14. At least a portion of the support members 36 on the second side wall 14 is aligned directly underneath, and parallel to, the top rail 24 on the second side wall 14. In the embodiments illustrated herein the support members 36 on the second feet 22 have a predetermined width and are secured in fixed space relationship to the lower portion 18 of the second side wall 14 by spacers 23.

Nesting pockets 25 and 26 are disposed along the side walls 13 and 14 respectively, for receiving the feet 22 and 21. The nesting pockets 25 and 26 are generally configured for mating relationship with the feet 21 and 22. As shown in FIGS. 14–18, each of the nesting pockets 25 and 26 has a horizontally disposed nesting ledge 40 for supporting the support members 36 when a foot 21 or 22 is seated within the nesting pockets 25 and 26. Accordingly, the support members 36 and ledge 40 have substantially the same width. The nesting pockets 25 and 26 extend downwardly from a top surface of respective side wall 13 or 14. The pockets 25 and 26 have an open top end and two parallel guide members 39 for guiding the feet 21 and 22 to the nesting ledge 40. The guide members 39 on the nesting pockets 25 depend parallel to one another from the top rail 24, to the nesting ledge 37. The guide members 39 of nesting pockets 26 depend paralleled to one another from the top surface 38 of the second side wall 14 to the nesting ledge 40.

In regard to

FIG. 2, 11, 17 and 19 there is illustrated the two nesting pockets 25 spaced apart on the exterior surface of first side wall 13, for receiving the feet 22 on the second side wall 14 when trays are nested. Each of these nesting pockets 25 is positioned above a respective foot 21 on the first side wall 13, but the nesting pockets 25 must be positioned on the first side wall 13 for alignment with a corresponding foot 22 on the second side wall 14, when the tray 11 is aligned over a like tray for nesting. The nesting pockets 25 abut the side wall 13 and project laterally outward from the tray 11, forming a wall section 37 backing the nesting pockets 25. A gap or spacer receiving means 28 extends vertically on the wall section 37 for receiving the spacer 23 when foot 22 nests within the nesting pocket 25. The nesting pockets 26 are formed in the second side wall 14 above each foot 22 for receiving the feet 21 on the first side wall 13, but the nesting pockets 26 must be positioned on the second side wall 14 to receive a corresponding foot 21 on the first side wall 13.

Figure 4:
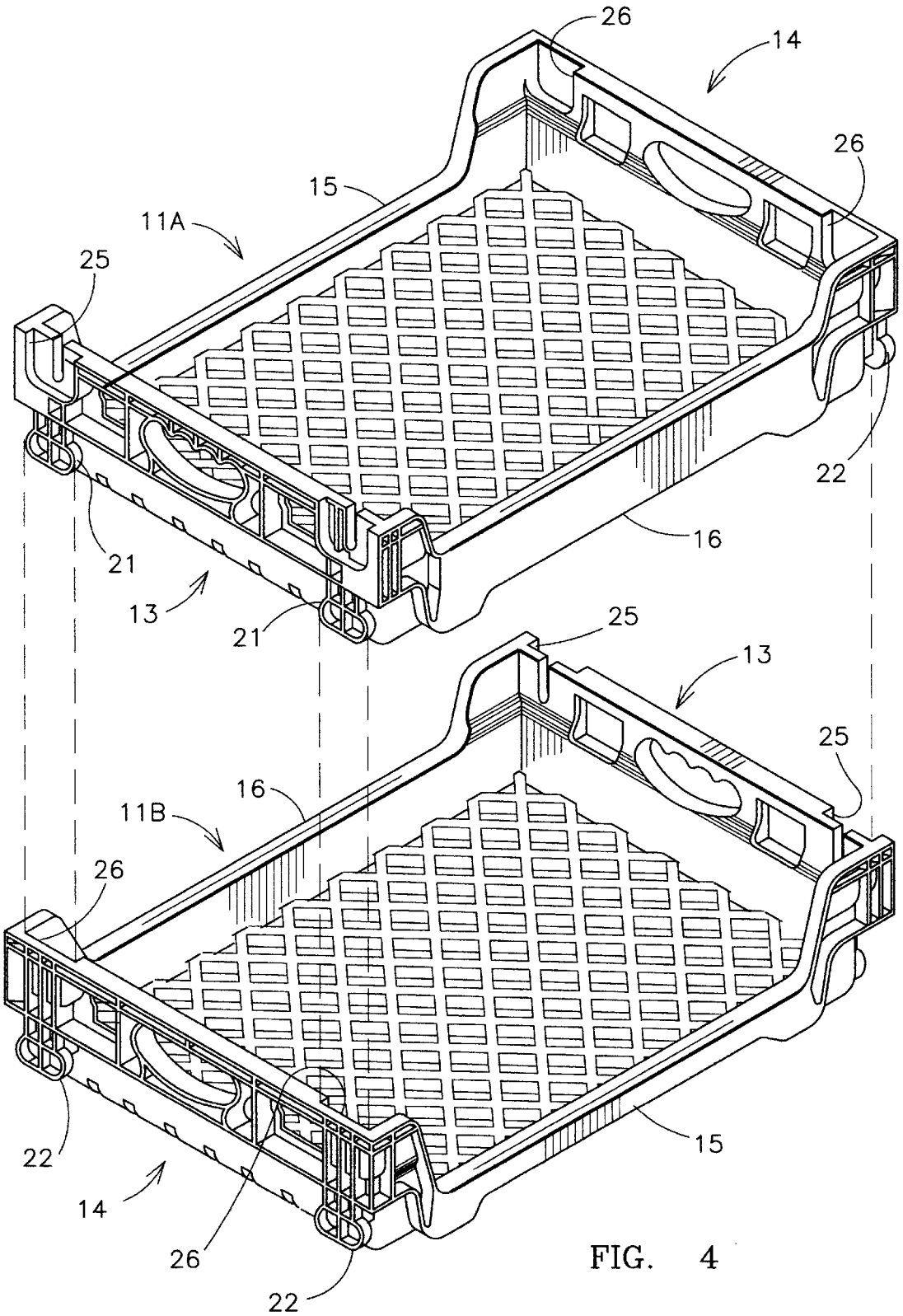
FIG. 4 is a perspective view of two empty trays aligned for nesting.
Figure 5:
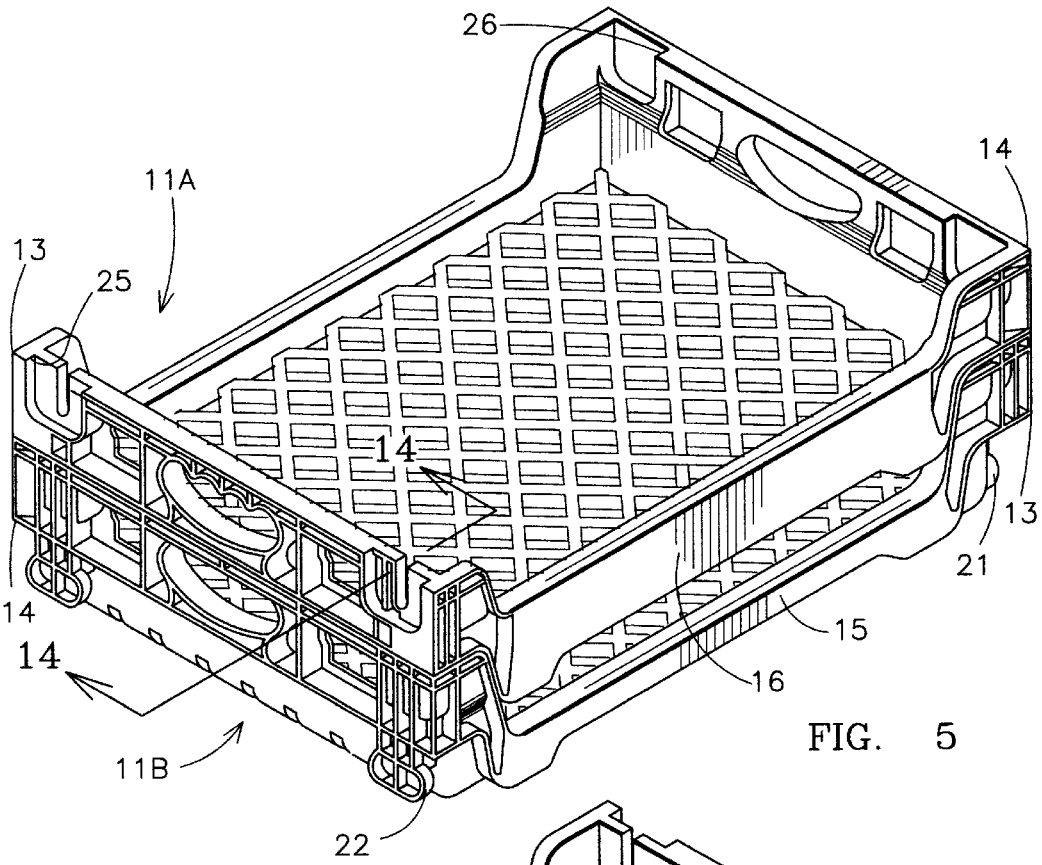
FIG. 5 is a rear perspective view of a top tray nesting within a bottom tray.
Figure 6:
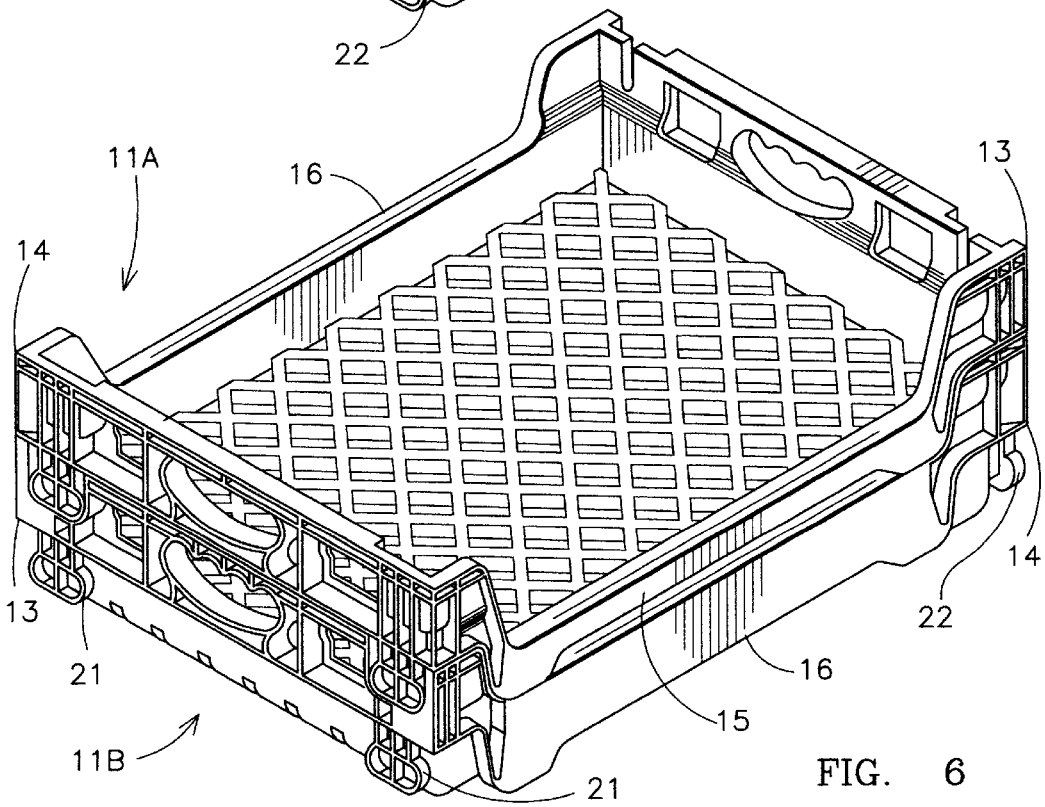
FIG. 6 is a front perspective view of a top tray nesting within a bottom tray.
Figure 14:
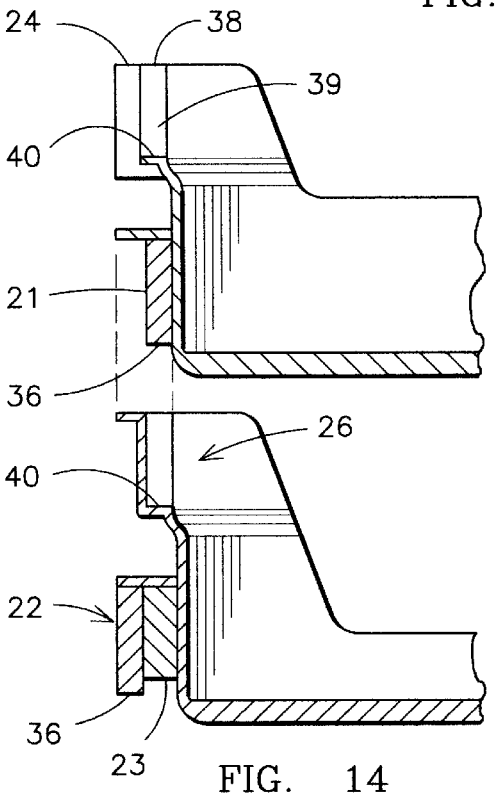
FIG. 14 is a sectional view of two trays aligned for nesting
Figure 15:
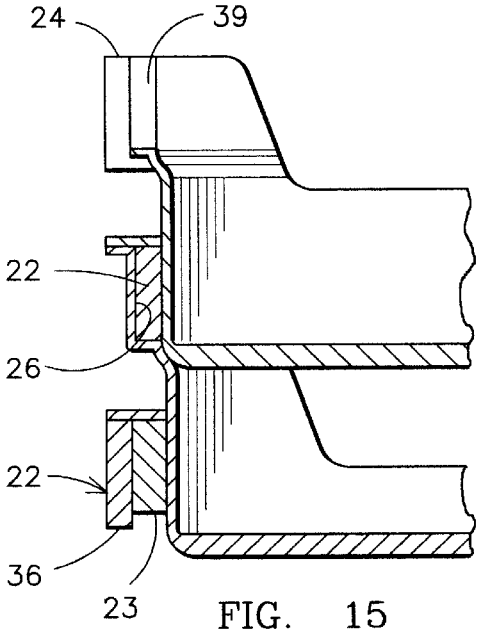
FIG. 15 is a sectional view of two trays aligned for nesting taken along line 15—15 in FIG 5.
Figure 16:
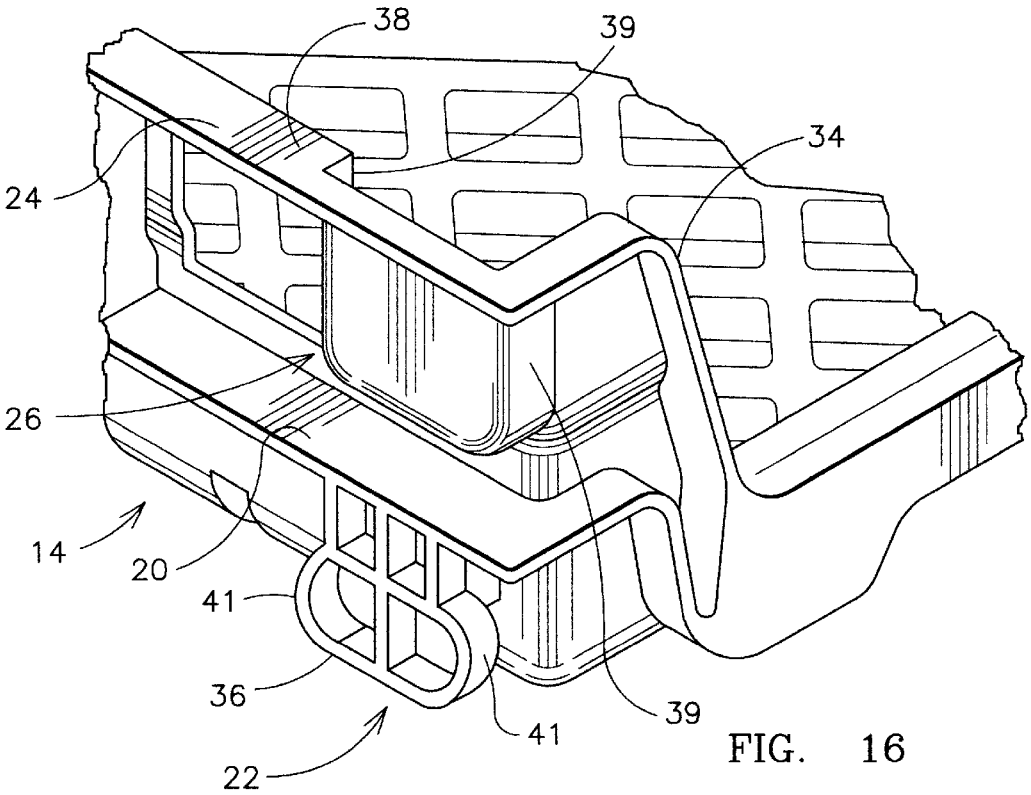
FIG. 16 is an expanded perspective view of a comer of the tray.
Figure 17:
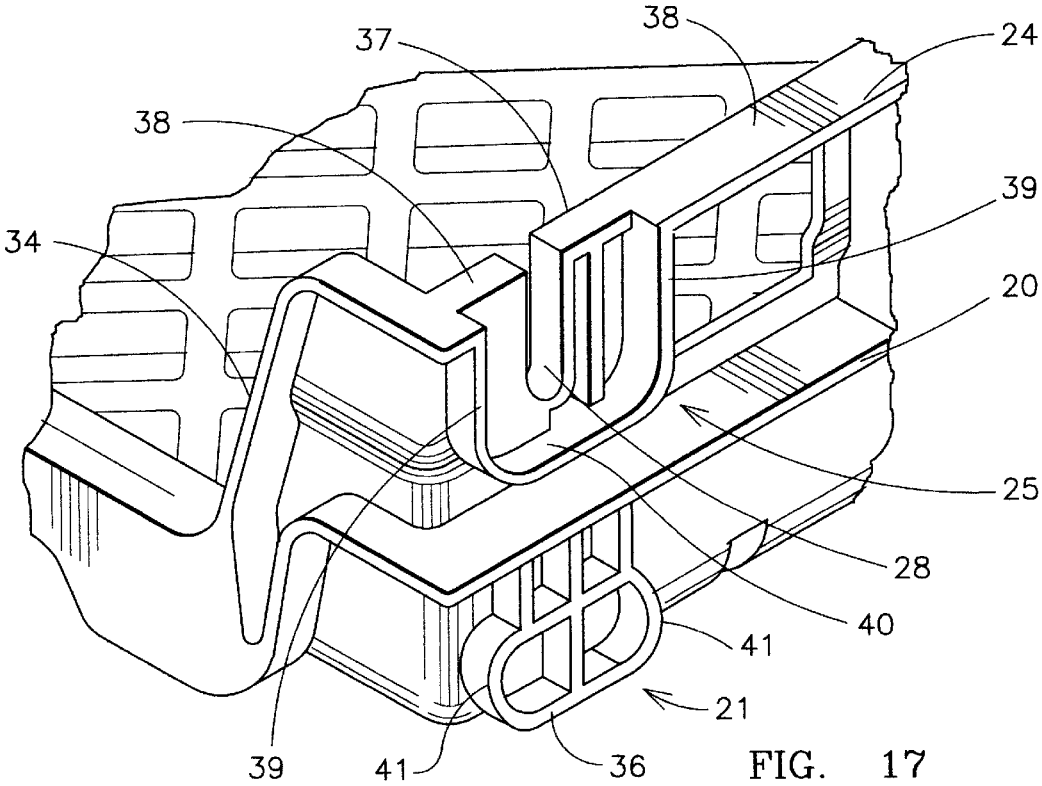
FIG. 17 is an expanded perspective view of a comer of the tray.

With respect to FIGS. 4 through 6, two trays 11A and 11B are shown nesting. The top tray 11A is placed in a first position with respect to the bottom tray 11B. The top tray 11A is positioned with respect to the bottom tray 11B, so the front wall 15 on the top tray 11A is positioned over the rear wall 16 on the bottom tray 11B. In this position, the first side wall 13 on the top tray 11A extends over the second side wall 14 of the bottom tray 11B; therefore, the feet 21 on the first side wall 13 of the top tray 11A seat within the nesting pockets 26 on the second side wall 14 of the bottom tray 11A. The sectional views in FIGS. 14 and 15 illustrate the nesting of the foot 21 on a first side wall 13 in a nesting pocket 26 which is disposed on the interior surface of the second side wall 14 of a bottom tray 11B.

Figure 20:
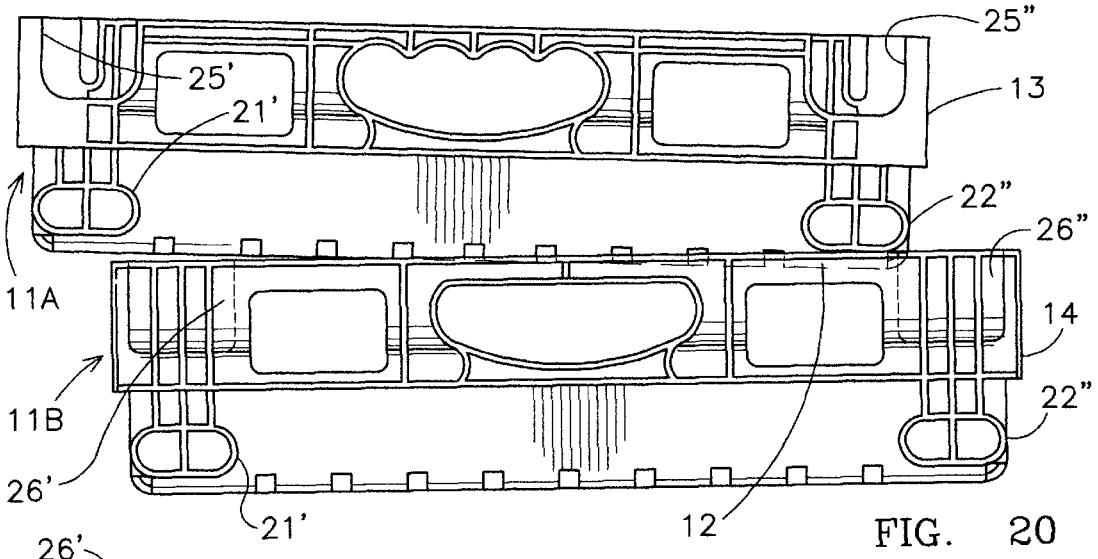
FIG. 20 is a side view of a top tray sliding on a bottom tray for nesting.
Figure 21:
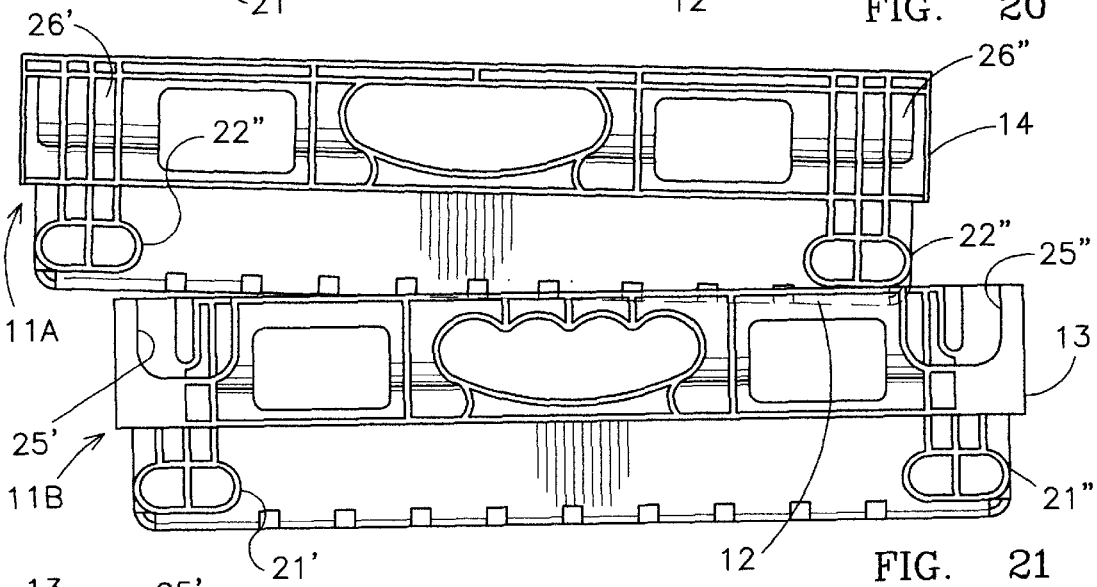
FIG. 21 is a side view of a top tray sliding on a bottom tray for nesting.

The tray 11 is also slidable on like trays to nest or stack the trays. In FIGS. 20–21, a top tray 11A is shown sliding on a bottom tray 11B for nesting and stacking trays. Note, the top tray 11A must be tilted slightly by a user grasping a front wall 15 or rear wall 16 of the top tray 11A because of extensions 34 (not shown) on the front wall 15 or rear wall 16 of the bottom tray 11B. The FIGS. 20 and 21 illustrate a top tray 11A slidable on a bottom tray 11B for nesting the top tray 11A within the bottom tray 11B. In FIG. 20, the rear wall 16 of the top tray 11A is tilted upward over the front wall 15 of the bottom tray 11B. The first side wall 13 of the top tray 11A is positioned over the second side wall 14 of the bottom tray 11B. For purposes of simplifying this description relating to FIGS. 20–22, the elements including feet 21 or 22 and nesting pockets 25 or 26, disposed toward the tilted end are designated as prime numbers, such as foot 21' or 22' and nesting pocket 26' or 25' on both the top tray 11A and bottom tray 11B. The elements distal the tilted end of the top tray 11A will be designated with double prime numbers, such as foot 21" or 22" and nesting pocket 26" or 25" on both the top and bottom trays 11A and 11B.

In FIG. 20, the top tray 11A is aligned over the bottom tray 11B for nesting as previously described. However, the feet 21" on the first side wall 13 of the top tray 11A are placed on the top surface 38, intermediate the nesting pockets 26' and 26", on the second side wall 14 of the bottom tray 11B. Similarly the feet 22" on the other side of top tray 11A engage the top rail 24 on the bottom tray 11B. In FIG. 21, the second side wall 14 of the top tray 11A is shown disposed over a first side wall 13 of the bottom tray 11B. The foot 22" engages the top rail 24 of the bottom tray 1I B intermediate the nesting pockets 25' and 25". The feet 22' and 22' will seat within corresponding nesting pockets 25' and 25".

A user is capable of pushing top tray 11A along the top rails 24 and top surface 38 on the bottom tray 11B. As the feet 21" and 22" approach the corresponding nesting pockets 26" and 25", the feet 21" and 22" simply drop within the nesting pockets 26" and 25". The tilted end of the top tray 11A is dropped so the feet 21' and 22' nest within corresponding nesting pockets 25' and 26' respectively.

Note, the floor 12 on the top tray 11A is disposed within the wall portion 17 of the side walls 13 and 14, the feet 21" and 22" on the second side wall 14 of the top tray 11A rest on the top surface 38 on the top rail 24 and are now longitudinally aligned for nesting with the nesting pockets 25" and 26". As the top tray 11A is pushed and slides on the bottom tray 11B, the feet 21" and 22" approach respective nesting pockets 26 and 25. In as much as the floor 12 of the top tray 11A is disposed within side walls 13 and 14 of the bottom tray 11B, the side walls 13 and 14 of the bottom tray 11B guide movement of the top tray 11A on the bottom tray 11B.

Figure 18:
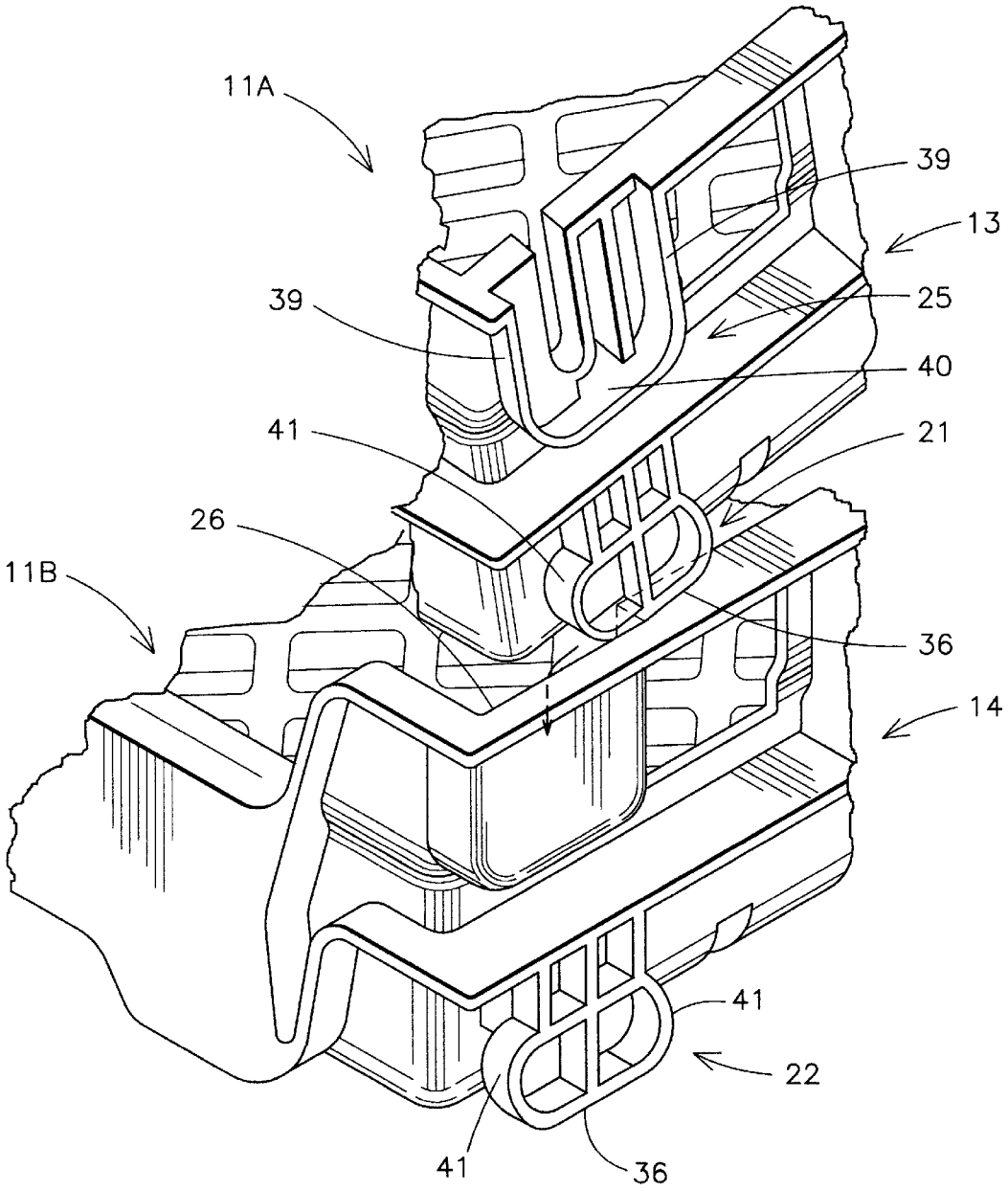
FIG. 18 is an expanded perspective view of a top tray positioned for nesting in a bottom tray.
Figure 19:
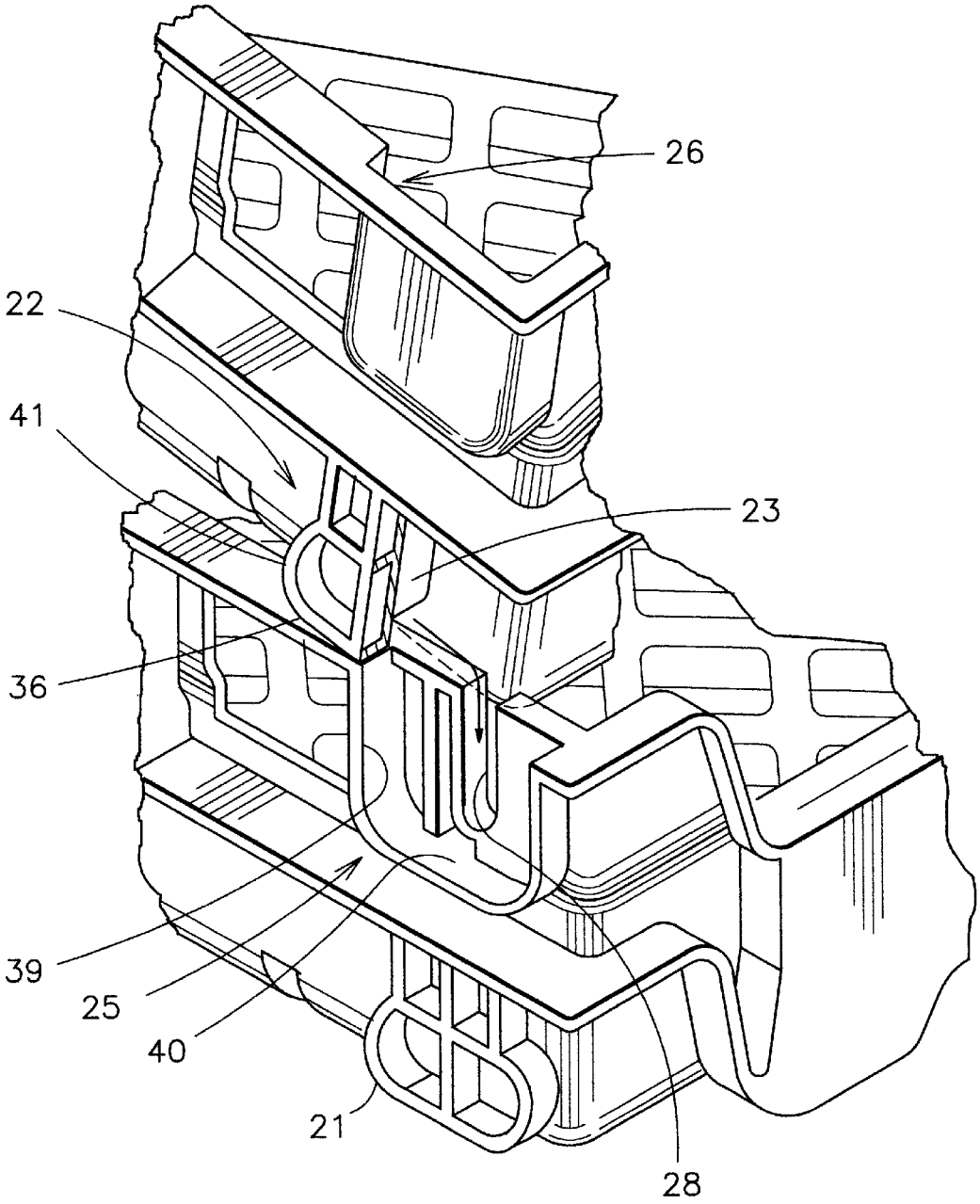
FIG. 19 is an expanded perspective view of a top tray position for nesting in a bottom tray.

With respect to FIGS. 18 and 19, feet 21 and 22 are shown approaching respective nesting pockets 26 and 25. When the feet 21 and 22 reach the distal nesting pockets 26 and 25, the feet 21 and 22 nest therein. Note, the top tray 11A is slightly tilted, so the foot 22 is initially lowered in the nesting pocket 25 at an angle. The user must push the wall 15 or 16 of the top tray 11A downward so the feet 21 and 22, closer to the user, will seat within corresponding nesting pockets 26 and 25. When the top tray 11A is so handled, the feet 21 and 22 must slightly pivot within nesting pockets to bring the top tray 11A to a horizontally disposed nesting position. Accordingly, all the feet 21 and 22 have the arcuate members 41 integral to the support members 36. The rounded surface of the arcuate member 41, allows the feet 21 and 22 to pivot against the guide members 39 of the nesting pockets. The feet 21 and 22 should be sufficiently wide to allow only minimal movement of the top tray 11A on the bottom tray 11B. In addition, there is sufficient room between the arcuate members 41 and the guide members 39 to allow the above-described pivoting when nesting.

In regard to FIGS. 4 through 6, the second side wall 14 on the top tray 11A extends over the first side wall 13 on the bottom tray 11B; therefore, the feet 22 on the second side wall 14 on the top tray 11A seat within the nesting pockets 25. The spacers 23 extend through the gaps 28 in the wall sections 37 so the feet 22 on the second side wall 14 of the top tray 11A seat within the nesting pockets 25 on bottom tray 11B. The outward displacement of the upper wall portion 17 permits the nesting of the lower wall portion 18 and floor 12 within the upper wall portion 17 of the bottom tray 11B. As shown in FIGS. 14 and 15, a comer end of the floor 12 nests adjacent the shoulder 33 extending between the upper wall 18 and lower wall 17 and 18 portion of the walls 13–16. In addition, as shown in FIGS. 10 and 19, the spacer 23 on foot 22 does not extend to the member 36. A sufficient amount of room must exist between the spacer 23 and the support member 36 so the foot 22 can pivot in the nesting pocket 25 to align the spacer 23 with gap 28; otherwise the spacer 23 will seat in the gap 28 and prevent the rotation of the foot 22 within the nesting pocket 25.

Figure 7:
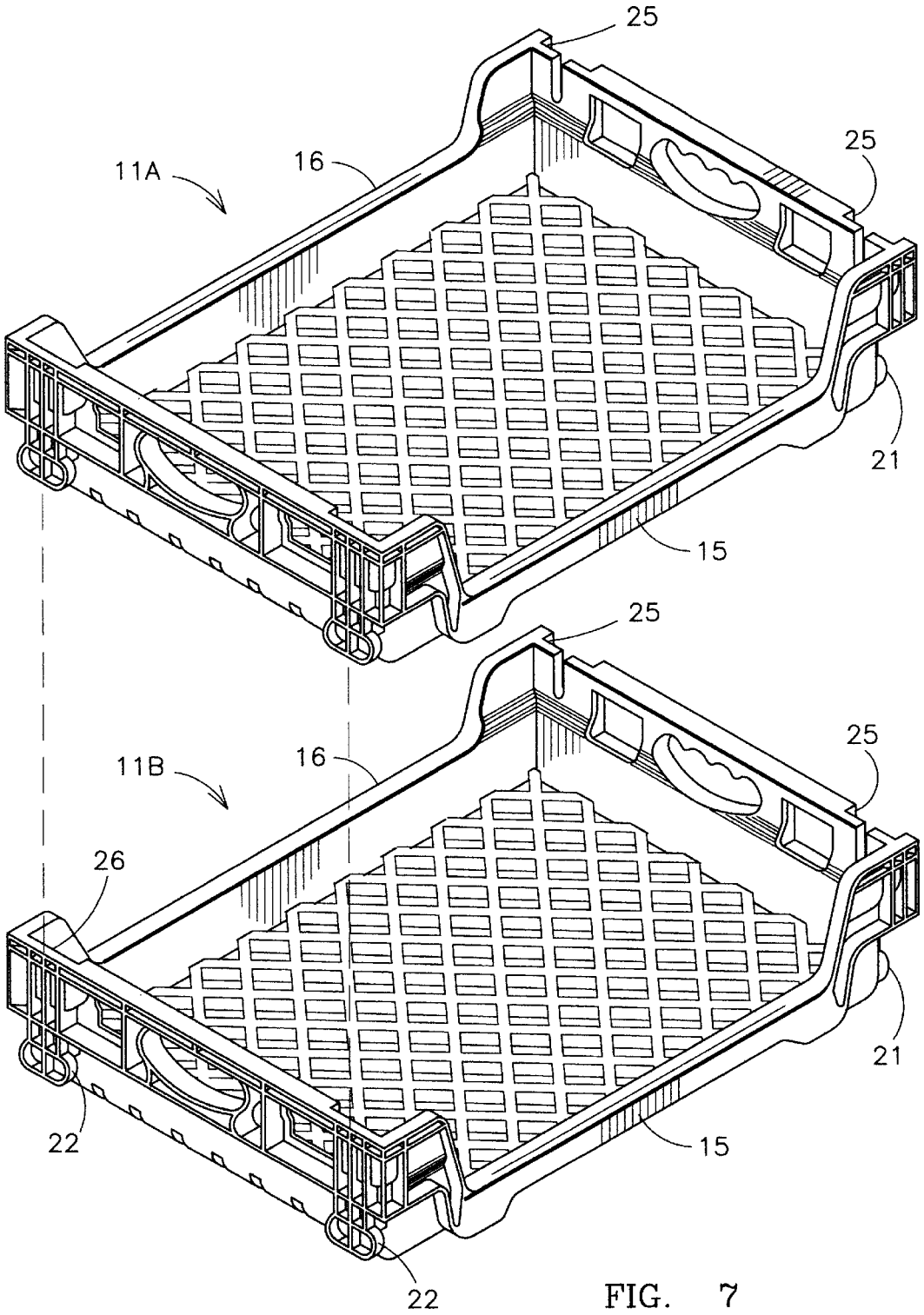
FIG. 7 is an expanded view of two trays aligned for stacking.
Figure 8:
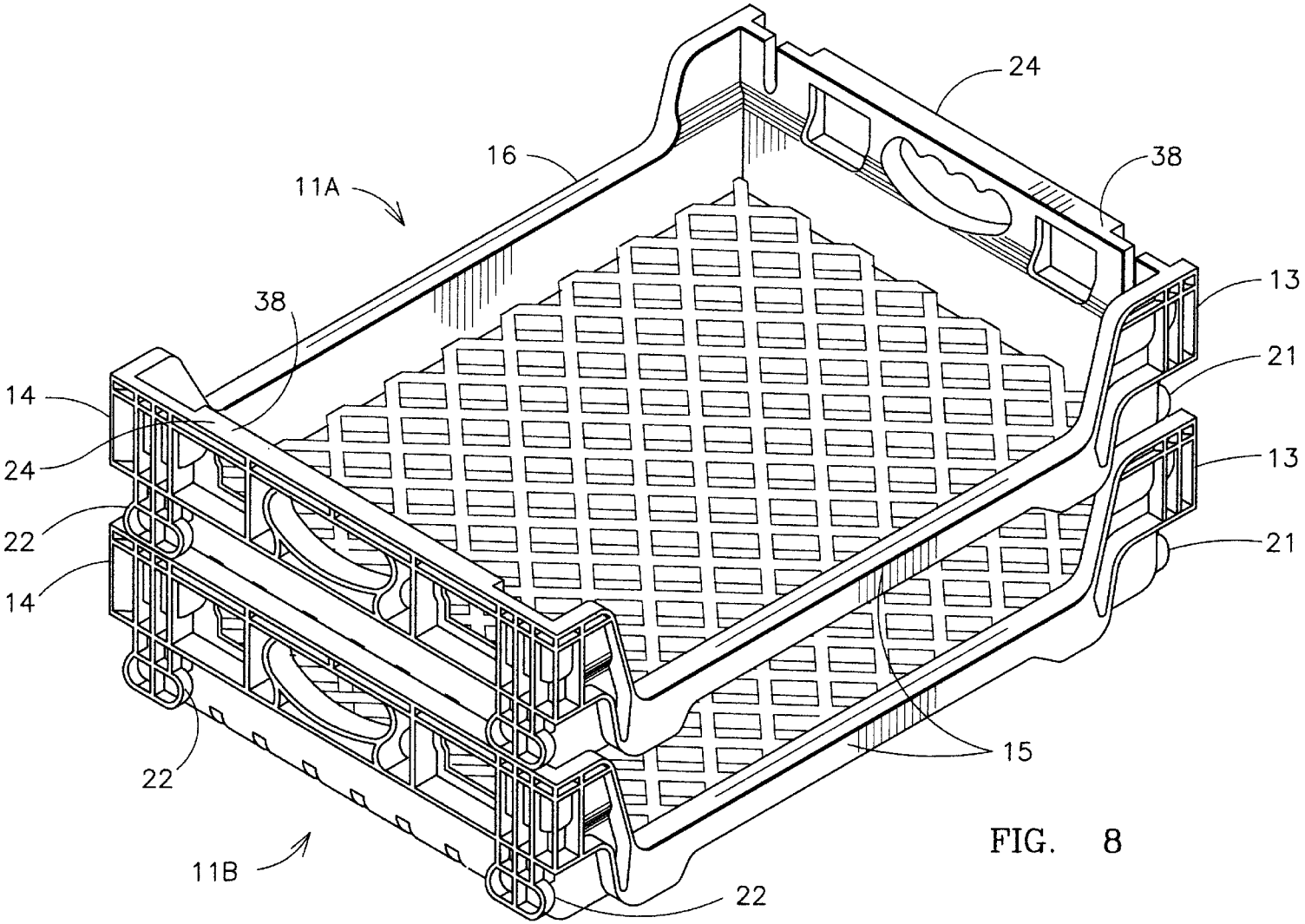
FIG. 8 is a perspective view of two trays stacked.

With respect to FIGS. 7 and 8, two trays including a top tray 11A and a bottom tray 11B are shown being stacked. When the top tray is oriented in a second position with respect to the bottom tray 11B for stacking. The front wall 15 and rear wall 16 on the top tray 11A are aligned over the respective walls 15 and 16 on the bottom tray 11B. The feet 21 on the first side wall 13 on the top tray 11A are positioned over the top surface 38 and wall sections 37 on the first side wall 13 on the bottom tray 11A. The support members 36 engage the top surface 38 of the wall sections 37 adjacent the first nesting pockets 25 on the first side wall 13. The feet 22 on the second side wall 14 of the top tray 11A are aligned over top rail 24 on the second side wall 14 of the bottom tray. The support members 36 on the feet 22 engage the top rail 24 and support the top tray 11A on the bottom tray 11B.

As shown in FIGS. 7 and 8, the floor 12 depends below the lower wall portion 18 and the feet 21 and 22. When the trays are stacked as described above, the floor 12 nests within the upper wall portion 17 of the bottom tray 11B. The support members 36 engage the wall sections 37 and the top rail 24 as described above, and the floor 12 extends within upper portion 18 of the bottom tray 11B. The side walls 13 and 14, and the extensions 34 on the front wall 15 and the rear wall 16 prevent the top tray 11A from sliding off the bottom tray 11B.

Figure 22:
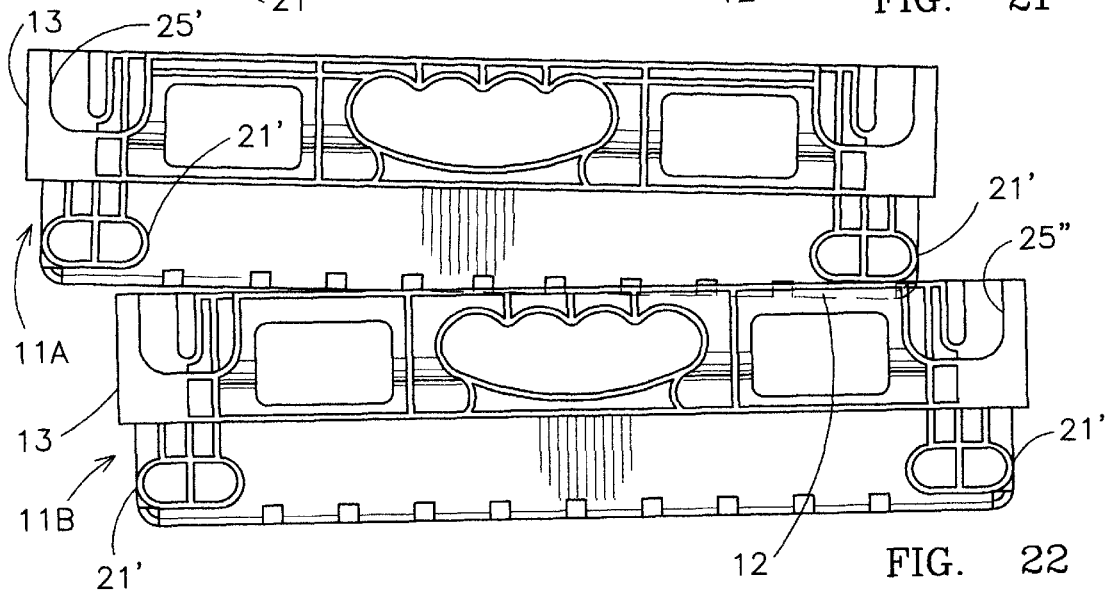
FIG. 22 is a side elevational view of a top tray sliding on a bottom tray for stacking.

In FIG. 22, a top tray 11A is illustrated as being positioned for stacking on a bottom tray 11B. When the trays 11 are prepared for stacking, the bottom tray 11B and top tray 11A are appropriately situated for stacking. The front wall 15 or rear wall 16 is facing the user, but the trays 11A and 11B are to be stacked so the walls 13–16 on the top tray 11A are aligned over respective walls 13–16 on the bottom tray 11B. In order to simplify the description of FIG. 21, the feet 21' and 22' toward the tilted end of the tray 11A are given a prime designation; and those feet 21 " and 22 " distal the tilted end of the tray 11A are given a double prime designation. The user places the top tray 11A on the bottom tray 11B for stacking with the top tray 11A offset toward the user. The feet 21 " and 22" on each respective side walls engage the top surfaces 38 of the side wall 13 and top rail 24 on the side wall 14. The top tray 11A is tilted upward slightly, so the floor 12 avoids the extension 34 on the front wall 15 of the bottom tray 11B. The floor 12 depends within the upper portion of the walls 13–16 of the bottom tray 11B. The user simply pushes the top tray 11A so it slides on the top surface 38 and top rail 24 toward the rear wall 16. The extensions 34 stop the tray when the floor 12 contacts the extension 34. The user drops the front wall 15 of the top tray 11A so feet 21' and 22' on both side walls 13 and 14 contact the bottom tray 11B. The floor 12 is disposed within the upper wall portion 17 of the bottom tray 11B, securing the top tray 11A in a stacked position on the bottom tray 11B, as previously described.

While we have disclosed the preferred embodiment of our invention, it is not intended that this description in any way limits the invention, but rather this invention should be limited only by a reasonable interpretation of the new recited claims.

I claim:

1. A bakery tray that is stackable and nestable on trays of a like design, said bakery tray comprising:

(a) a substantially rectangular floor having a top and a bottom;

(b) a retainer wall extending along a periphery of the floor, said retainer wall having a front wall opposing a rear wall and a first side wall opposing a second side wall;

(c) at least one first support member outwardly projecting from an exterior surface of the first side wall, for supporting said tray in a stacked or nested position on a like tray;

(d) at least one second support member outwardly projecting from an exterior surface of the second side wall, for supporting said tray in a stacked or nested position on a like tray;

(e) a first nesting pocket, disposed along an exterior surface of the first side wall at a height above said first support member, for receiving said second support member on the second side wall from a like tray nested within said tray, said first nesting pocket projecting outwardly from said first side wall and extending downwardly from a top surface of the first side wall, said first nesting pocket having a horizontally disposed nesting ledge for supporting said second support member on the second side wall of a like tray; and, (f) a second nesting pocket, disposed within an interior of the tray along the second side wall at a height above said second support member on the second side wall, for receiving said first support member on the first side wall from a like tray nested within said tray, and said second nesting pocket depending downwardly from a top surface of the second side wall and having a horizontally disposed ledge for supporting said first support member.

2. A bakery tray as defined in claim 1 wherein said support member includes a horizontally disposed member, and said tray includes a pair of arcuate members and each arcuate member is integral to a corresponding end of the support member.

3. A bakery tray as defined in claim 1 wherein said top surface of each said first side wall and said second side wall is a top planar surface, extending intermediate said rear wall and said front wall, for supporting the first support member on a first side wall of a like tray stacked on top of said tray or positioned on said tray for nesting, a portion of the first support member on the first side wall being disposed directly underneath the top planar surface of the first side wall, and said tray further having a rail integral to, and coplanar with, the top planar surface of each said first side wall and second side wall and projecting outwardly therefrom, each said rail extending intermediate the front wall and rear wall for supporting the second support member on the second side wall when a like tray is stacked on top of the tray or positioned thereon for nesting, a portion of the second support member being disposed directly underneath the rail on the second side wall.

4. A bakery tray as defined in claim 3 wherein said first nesting pocket includes an open top end adjacent said rail of the first side wall and a pair of vertically disposed guide members depending from said rail on said first side wall, parallel to one another, to said nesting ledge, and said second nesting pockets having an open top end adjacent said top surface of the second side wall and a pair of guide members depending from said top surface of the second side wall, parallel to one another, to said nesting ledge.

5. A bakery tray as defined in claim 3 further including a spacer intermediate the second side wall and said second support member, securing the second support member in fixed spaced relation to said second side wall, and a spacer receiving means formed in the first side wall adjacent said first nesting pocket.

6. A bakery tray as defined in claim 3 further including means, integral the retainer wall, for securing a top bakery tray on a bottom bakery tray when said trays are stacked, whereby said first support member on the first side wall of the top tray engages the top surface of the first side wall on the bottom tray, and said second support member on the second side wall of the top tray engages the top rail on the second side wall of the bottom tray.

7. A bakery tray as defined in claim 6 wherein said front wall and said rear wall have a height lower than that of the first side wall and the second side wall, and said securing means includes the first side wall, the second side wall, and a first pair of extensions integral said rear wall extending upward from the rear wall, and each said extension is spaced apart on the rear wall disposed toward the side walls and integral thereto, said securing means also including a second pair of extensions integral said front wall extending upward from the front wall, and each said second extension disposed on the front wall opposing the first extensions and integral to the side walls, and said floor on a top tray depends from the side walls below the first support member and the second support member such that said floor is disposed within the retainer wall of the bottom tray when stacked.

8. A bakery tray as defined in claim 1 wherein said retainer wall includes an upper wall portion, along which said first and second nesting pockets are disposed, and a lower wall portion from which the first and second support members project, and said upper wall portion is displaced outward toward an exterior of the tray, and said lower wall portion and floor are disposed within the upper wall portion when nested or stacked with a like tray.

9. A bakery tray as defined in claim 8 wherein said top surface of each said first side wall and said second side wall is a top planar surface, extending intermediate said rear wall and said front wall, for supporting the first support member on a first side wall of a like tray stacked on top of said tray or positioned on said tray for nesting, a portion of the first support member on the first side wall being disposed directly underneath the top planar surface of the first side wall, and said tray further having a rail integral to, and coplanar with, the top planar surface of each said first side wall and second side wall and projecting outwardly therefrom, each said rail extending intermediate the front wall and rear wall for supporting the second support member on the second side wall when a like tray is stacked on top of the tray or positioned thereon for nesting, a portion of the second support member being disposed directly underneath the rail on the second side wall.

10. A bakery tray as defined in claim 9 wherein said first nesting pocket includes an open top end adjacent said rail of the first side wall and a pair of vertically disposed guide members depending from said rail on said first side wall, parallel to one another, to said nesting ledge, and said second nesting pockets having an open top end adjacent said top surface of the second side wall and a pair of guide members depending from said top surface of the second side wall, parallel to one another, to said nesting ledge.

11. A bakery tray as defined in claim 9 further including a spacer intermediate the second side wall and said second support member, securing the second support member in fixed spaced relation to said second side wall, and a spacer receiving means formed in the first side wall adjacent said first nesting pocket.

12. A bakery tray as defined in claim 11 further including means, integral the retainer wall, for securing a top bakery tray on a bottom bakery tray when said trays are stacked, whereby said first support member on the first side wall of the top tray engages the top surface of the first side wall on the bottom tray, and said second support member on the second side wall of the top tray engages the top rail on the second side wall of the bottom tray.

13. A bakery tray as defined in claim 12 wherein said front wall and said rear wall have a height lower than that of the first side wall and the second side wall, and said securing means includes the first side wall, the second side wall, and a first pair of extensions integral said rear wall extending upward from the rear wall, and each said extension is spaced apart on the rear wall disposed toward the side walls and integral thereto, said securing means also including a second pair of extensions integral said front wall extending upward from the front wall, and each said second extension disposed on the front wall opposing the first extensions and integral to the side walls, and said floor on a top tray depends from the side walls below the first support member and the second support member such that said floor is disposed within the retainer wall of the bottom tray when stacked.

14. A bakery tray that is stackable and nestable on trays of a like design, said bakery trays comprising:

(a) a substantially rectangular floor having a top and bottom;

(b) a retainer wall extending along a periphery of the floor, said retainer wall having a front wall opposing a rear wall and a first side wall opposing a second side wall;

(c) a plurality of first support members horizontally spaced apart along said first side wall and projecting outwardly from an exterior surface of the first side wall;

(d) a plurality of second support members horizontally spaced apart along said second side wall and projecting outwardly from an exterior surface of the second side wall, and said first and second support members for supporting said tray in a nested or stacked position on a like tray;

(e) a plurality of first nesting pockets spaced apart horizontally along an exterior surface of the first side wall at a height above the first support members and projecting outwardly from said first side wall and downwardly from a top surface of the first side wall, and each said first nesting pocket positioned on the first side wall for receiving one of the second support members on the second side wall from a like tray nested thereon, and said first nesting pocket having a horizontally disposed nesting ledge for supporting said second support member on the second side wall of a like tray; and, (f) a plurality of second nesting pockets spaced apart horizontally along an interior surface of the second side wall at a height above the second support members, and each said second nesting pocket is positioned on the second side wall for receiving one of the first support members on the first side wall from a like tray nested thereon, and said second nesting pocket having a horizontally disposed nesting ledge for supporting said first support member on the first side wall of a like tray.

15. A bakery tray as defined in claim 14 wherein said top surface of the first side wall and said second side wall is a top planar surface extending intermediate said rear wall and said front wall, and having a uniform width equal to the thickness of the respective side walls, for supporting the first support members on a first side wall of a like tray stacked on top of said tray or positioned for nesting with said tray, and said first support members aligned longitudinally along the first side wall and a portion of each of the first support members on the first side wall being disposed directly underneath the top planar surface of the first side wall, and said tray further having a rail integral to, and coplanar with, the top planar surface of each said first side wall and second side wall and the rail projecting outward therefrom, each said rail extending intermediate the front wall and rear wall, and having a uniform width, for supporting the second support members on the second side wall when a like tray is stacked on top of the tray or positioned thereon for nesting, a portion of each of the second support members being disposed directly underneath the rail on the second side wall.

16. A bakery tray as defined in claim 15 wherein said first nesting pocket includes an open top end adjacent said rail of the first side wall and a pair of vertically disposed guide members depending from said rail on said first side wall parallel to one another to said nesting ledge, and said second nesting pockets having an open top end adjacent said top surface of the second side wall and a pair of guide members depending from said top surface of the second side wall parallel to one another to said nesting ledge.

17. A bakery tray as defined in claim 15 further including a plurality of spacers horizontally spaced apart along the second side wall, and each spacer extending intermediate the second side wall and a respective second support member, securing each said second support member in fixed spaced relation to said second side wall, and a spacer receiving means, formed in the first side wall adjacent each said first nesting pocket, having on open top end in the top surface of the second side wall and extending downwardly therefrom.

18. A bakery tray as defined in claim 17 further including means, integrally formed at the respective comers of the retainer walls and extending along said side walls, for securing a top bread tray on a bottom tray when said trays are stacked.

19. A bakery tray as defined in claim 18 wherein said front wall and said rear wall have a height lower than that of the first side wall and the second side wall, and said securing means includes the first side wall, the second side wall, and a first pair of extensions integral said rear wall extending upward from the rear wall, and each said extension is spaced apart on the rear wall disposed toward the side walls and integral thereto, said securing means also including a second pair of extensions integral said front wall extending upward from the front wall, and each said second extension disposed on the front wall opposing the first extensions and integral to the side walls, and said floor on a top tray depends from the side walls below the first support member and the second support member such that said floor is disposed within retainer wall of the bottom tray when stacked.

20. A bakery tray as defined in claim 15 wherein said retainer wall includes an upper wall portion, along which said first and second nesting pockets are disposed, and a lower wall portion from which the first and second support members project, and said upper wall portion is displaced outward toward an exterior of the tray, and said lower wall portion and the floor are disposed within the upper wall portion when nested or stacked within a like tray.

21. A bakery tray as defined in claim 20 wherein said top surface of each said first side wall and said second side wall is a top planar surface extending intermediate said rear wall and said front wall, and having a uniform width equal to the thickness of the side wall, for supporting the first support members on a first side wall of a like tray stacked on top of said tray or positioned for nesting with said tray, and said first support members aligned longitudinally along the first side wall and a portion of each of the first support members on the first side wall being disposed directly underneath the top planar surface of the first side wall, and said tray further having a rail integral to, and coplanar with, the top planar surface of each said first side wall and second side wall and projecting outward therefrom, each said rail extending intermediate the front wall and rear wall, and having a uniform width, for supporting the second support member on the second side wall when a like tray is stacked on top the tray or positioned thereon for nesting, a portion of the second support member being disposed directly underneath the rail on the second side wall.

22. A bakery tray as defined in claim 21 wherein said first nesting pocket includes an open top end adjacent said rail of the first side wall and a pair of vertically disposed guide members depending from said rail on said first side wall, parallel to one another, to said nesting ledge, and said second nesting pockets having an open top end adjacent said top surface of the second side wall and a pair of guide members depending form said top surface of the second side wall parallel to one another to said nesting ledge.

23. A bakery tray as defined in claim 21 further including a plurality of spacers horizontally spaced apart along the second side wall, and each spacer extending intermediate the second side wall and a respective second support member, securing each said second support member in fixed spaced relation to said second side wall, and a spacer receiving means, formed in the first side wall adjacent each said first nesting pocket, having on open top end in the top surface of the second side wall and extending downwardly therefrom.

24. A bakery tray as defined in claim 23 further including means, integrally formed at the respective corners of the retainer walls and extending along said side walls, for securing a top bread tray on a bottom tray when said trays are stacked.

25. A bakery tray as defined in claim 24 wherein said front wall and said rear wall have a height lower than that of the first side wall and the second side wall, and said securing means includes the first side wall, the second side wall, and a first pair of extensions integral said rear wall extending upward from the rear wall, and each said extension is spaced apart on the rear wall disposed toward the side walls and integral thereto, said securing means also including a second pair of extensions integral said front wall extending upward from the front wall, and each said second extension disposed on the front wall opposing the first extensions and integral to the side walls, and said floor on a top tray depends from the side walls below the first support foot and the second support foot such that said floor is disposed within retainer wall of the bottom tray when stacked.

26. A bakery tray as defined in claim 25 wherein said retainer wall includes an upper wall portion, along which said first and second nesting pockets are disposed, and a lower wall portion from which the first and second support members project, and said upper wall portion is displaced outward toward an exterior of the crate and said lower wall portion and floor disposed within the upper wall portion when nested within a like tray.

27. A bakery tray as defined in claim 14 wherein said support member includes a horizontally disposed member, and said tray includes a pair of arcuate members and each arcuate member is integral to a corresponding end of the support member.

28. A bakery tray that is stackable and nestable on trays of a like design, said bakery trays comprising:

(a) a substantially rectangular floor having a top and bottom;

(b) a retainer wall extending along a periphery of the floor, said retainer wall having a front wall opposing a rear wall and a first side wall opposing a second side wall, and said retainer wall having an upper wall portion and a lower wall portion, said upper wall displaced outward with respect to said lower wall portion toward an exterior of the tray;

(c) a plurality of first support members horizontally spaced apart along said first side wall and projecting outwardly from an exterior surface of the first side wall;

(d) a plurality of second support members horizontally spaced apart along said second side wall and projecting outwardly from an exterior surface of the second side wall, and said first and second support members for supporting said tray in a nested or stacked position on a like tray;

(e) a plurality of first nesting pockets spaced apart horizontally along an exterior surface of the first side wall at a height above the first support members, and each said first nesting pocket positioned on the first side wall for receiving one of the second support members on the second side wall from a like tray nested thereon, and said first nesting pockets projecting outwardly from said first side wall and downwardly from a top surface of the first side wall; and, (f) a plurality of second nesting pockets spaced apart horizontally along an interior surface of the second side wall at a height above the second support members, and each said second nesting pocket is positioned on the second side wall for receiving one of the first support members on the first side wall from a like tray nested thereon; and, (g) said top surface of each said first side wall and said second side wall is a top planar surface extending intermediate said rear wall and said front wall, and having a uniform width equal to the thickness of the side wall, for supporting the first support members on a first side wall of a like tray stacked on top of said tray or positioned thereon for nesting with said tray, and said first support members aligned longitudinally along the first side wall and a portion of each of the first support members on the first side wall being disposed directly underneath the top planar surface of the first side wall, and said tray further having a rail integral to, and coplanar with, the top planar surface of each said first side wall and second side wall and projecting outward therefrom, each said rail extending intermediate the front wall and rear wall, and having a uniform width, for supporting the second support member on the second side wall when a like tray is stacked on top the tray or positioned thereon for nesting, a portion of each said second support member being disposed directly underneath the rail on the second side wall.

29. A bakery tray as defined in claim 28 further including a plurality of spacers horizontally spaced apart along the second side wall, and each spacer extending intermediate the second side wall and a respective second support member, securing each said second support member in fixed spaced relation to said second side wall, and a spacer receiving means, formed in the first side wall adjacent each said first nesting pocket, having on open top end in the top surface of the second side wall and extending downwardly therefrom.

30. A bakery tray as defined in claim 29 wherein said first nesting pocket includes an open top end adjacent said rail of the first side wall and a pair of vertically disposed guide members depending from said rail on said first side wall parallel to one another to said nesting ledge, and said second nesting pockets having an open top end adjacent said top surface of the second side wall and a pair of guide members depending form said top surface of the second side wall parallel to one another to said nesting ledge.

31. A bakery tray as defined in claim 30 further including means, integrally formed at the respective comers of the retainer walls and extending along said side walls, for securing a top bread tray on a bottom tray when said trays are stacked.

32. A bakery tray as defined in claim 31 wherein said front wall and said rear wall have a height lower than that of the first side wall and the second side wall, and said securing means includes the first side wall, the second side wall, and a first pair of extensions integral said rear wall extending upward from the rear wall, and each said extension is spaced apart on the rear wall disposed toward the side walls and integral thereto, said securing means also including a second pair of extensions integral said front wall extending upward from the front wall, and each said second extension disposed on the front wall opposing the first extensions and integral to the side walls, and said floor on a top tray depends from the side walls below the first support foot and the second support foot such that said floor is disposed within retainer wall of the bottom tray when stacked.

33. A bakery tray as defined in claim 28 wherein said support member includes a horizontally disposed member, and said tray includes a pair of arcuate members and each arcuate member is integral to a corresponding end of the support member.

* * * * *